United States Patent [19]

Miyagishima et al.

[11] 4,323,256

[45] Apr. 6, 1982

[54] FRONT PACKER SEAL FOR RAM BLOWOUT PREVENTER

[75] Inventors: Tosh Miyagishima; Calvin Motoda, both of Los Angeles, Calif.

[73] Assignee: Hydril Company, Los Angeles, Calif.

[21] Appl. No.: 145,248

[22] Filed: Apr. 30, 1980

[51] Int. Cl.[3] ..... E21B 33/06

[52] U.S. Cl. ..... 277/126; 251/1 A; 251/368

[58] Field of Search ..... 251/1 A, 368; 166/363, 166/364; 277/126, DIG. 6, 12

[56] References Cited

U.S. PATENT DOCUMENTS

| | | | |
|---|---|---|---|
| 2,593,793 | 4/1952 | Rector | 251/1 A |
| 2,644,804 | 7/1953 | Rubin | 277/DIG. 6 |
| 2,908,537 | 10/1959 | Kipp | 277/DIG. 6 |
| 3,880,436 | 4/1975 | Canal | 277/126 |
| 3,904,212 | 9/1975 | Pugh et al. | 277/126 |
| 3,946,806 | 3/1976 | Meynier | 251/1 A |
| 4,265,424 | 5/1981 | Jones | 251/1 A |

*Primary Examiner*—Robert I. Smith

*Attorney, Agent, or Firm*—Pravel, Gambrell, Hewitt, Kirk, Kimball & Dodge

[57] ABSTRACT

An improved seal for a blowout preventer ram which can be moved into and out of engagement with a length of pipe and includes intersecting recesses formed in the outer surfaces of the ram body for accommodating seal for forming a pressure-tight seal around the length of pipe and between the ram and at least a portion of a housing in which the ram moves when the ram engages the pipe. The seal includes a front seal with a curved portion shaped to engage the length of pipe and a body portion formed of an elastomeric material shaped to fit within one of the recesses in the ram. An insert in the body portion is formed of a deformable material with low friction properties and positioned to engage the pipe when the ram is in its engaging position. The insert is held between a pair of rigid retainer plates oriented perpendicular to the pipe. The seal engages a second top seal located in the other recess and pushes it outwardly into sealing positions when force is exerted on the front seal.

15 Claims, 5 Drawing Figures

FRONT PACKER SEAL FOR RAM BLOWOUT PREVENTER

TECHNICAL FIELD

This invention relates to ram-type blowout preventers (e.g. BOP's) which are used to seal the outside diameter of drill pipe while working under pressure and, more particularly, to an improved front packing seal for the ram portion of such a BOP.

When pipe is run into a well which has a relatively high wellhead pressure such as, for example, where the pressure exceeds 3,000 pounds per square inch, ram-type BOP's are used in what is known as a "stripping" operation where pipe is run through BOP units which engage and form a seal around the pipe for maintaining well pressure while the pipe moves into or out of the well. In one arrangement, three ram-type BOP units are provided, an upper stripping BOP, a lower stripping BOP, and a safety BOP located below the other two. The upper BOP is positioned to engage the pipe as it is lowered into the well while the other two BOP's are open. As a pipe joint approaches the upper BOP, the lower BOP is closed and pressure between it and the upper BOP is equalized. The upper BOP is then opened and the pipe joint allowed to move into the area between the two BOP's. The upper BOP is then closed, pressure equalized once again and the lower stripping BOP opened so that the pipe can continue to be lowered into the well. The safety BOP remains open and is closed only during emergencies or when the seals of the other BOP's are changed.

Different types of seals have been used with this type of BOP. Normally front seals mounted on oppositely facing rams engage the pipe and top seals which extend from the rear ends of the front seals and around the tops of the rams engage the housing in which the rams move for effectively providing a pressure-tight seal.

BACKGROUND ART

U.S. Pat. No. 3,744,749, which is assigned to the same corporate entity to which the present invention is assigned, describes and shows a ram-type BOP where a ram sealing member 41 formed of rubber is held between metal retainer plates 42 for preventing extrusion of the rubber when it is in the sealing or closed position. A top seal 44 is formed integral with sealing member 41 as shown in FIG. 2. U.S. Pat. No. 3,647,174 teaches a similar integrally-formed top and front BOP seal 15. U.S. Pat. No. 3,791,616 shows a ram-type BOP with a front packer seal 16 located between rigid retainer plates 16*a* and 16*b* and a top seal element 17.

Other types of seals for ram-type BOP's are shown and described in the *Composite Catalog of Oilfield Equipment and Services,* 1976–1977 (vol. 2), p. 3303 where a ram-type BOP for the Hydril Company, which owns the present invention, is shown in detail. The front packer and top seals are formed as separate elements and are removably mounted in grooves formed in the BOP ram. The elements can be removed and replaced when worn. Other seals formed of rubber with fiber or polyurethane replacable inserts have also been used.

SUMMARY OF THE INVENTION

In accordance with the invention, an improved front packer seal for a ram-type BOP is provided. The front packer seal has a main body formed of an elastomeric material such as synthetic or natural rubber which can be inserted in a slot which extends through the front and side surfaces of a BOP ram. The seal has a semi-circular shaped portion which engages the outer surface of the pipe and cooperates with an identical seal located in another ram on the other side of the pipe for forming a high-pressure, fluid-tight seal around the pipe when the seals are positioned to engage the pipe and each other.

The portion of the seal which engages the pipe is an insert formed of a material which has low friction properties and is self-lubricating so that the insert will have a long useful life. A material found to be satisfactory for these purposes is made up of 75% by weight tetrafluoroethylene, 2% molybdenum disulfide, and 23% fiberglass and is sold under the trademark Jaylon 18. The insert is molded in the seal body between two rigid plates which prevent extrusion of the insert when it engages the pipe and packer seal on the opposite ram. The seal is self-energizing so that when the rams engage the pipe reactive force is transmitted from the rams through the body of the elastomer seals so that the insert will come into fluid-tight engagement with the pipe.

The body of the packer seal includes a pair of contact surfaces on lugs projecting from the rear end of the seal, which are formed at an acute angle on the seal for engaging cooperating contact surfaces located on the lower ends of an U-shaped top seal which is also mounted in a groove around the top surface of the ram. Force exerted on the front end of the packer seal is transmitted to the top seal through the contact surfaces and causes the top seal to move outwardly and engage its cooperating housing for completing the pressure-tight seal. When force on the front end of the packer seal is relieved by retracting the rams, the top seal will return to its initial position and eliminate frictional contact between the seal and surrounding housing which increases seal life since the top seal does not tightly engage the housing when the ram moves back and forth.

Both the front packer and top seals can be replaced when they wear out simply by pulling them out of their respective recesses and inserting new ones. The top seal includes a pair of retainer pins, one projecting downwardly from each end, for engaging openings formed in the contact surfaces of the packer seal. A second pair of openings is formed in the body of the packer seal through which retainer pins inserted through openings in the ram can be inserted for holding the packer seal in place within the ram.

The packer seal can be formed by fabricating an insert of the type described above and etching the entire insert with a compound known as Tetraetch which is a tetrafluoroethylene etching compound purchased from Fluorocarbon Company, Los Angeles, Calif. A rubber-to-metal bonding adhesive such as a compound known as TY-PLY-BN sold by the Lord Corporation, Erie, Pa., is applied to all surfaces of the insert except the portion which engages the drill pipe. The insert and rigid retaining plates are placed in a mold and the mold is charged with the elastomer which is then cured.

In this way, a replacable front packer seal is provided for a ram-type BOP which has optimum characteristics for performing stripping operations. The portion of the seal which engages moving pipe is formed of a material which has relatively low friction and is self-lubricating for increasing the useful life of such a seal. Interaction between the front packer and top seals increases the useful life of the top seal since it does not tightly engage the surrounding housing until a seal is formed around the pipe. Replacement of the two seals is a simple operation which can be done easily and quickly.

BRIEF DESCRIPTION OF DRAWINGS

A better understanding of the invention will be obtained when the detailed description set forth below is considered in conjunction with the following drawings, in which.

BEST MODE FOR CARRYING OUT THE INVENTION

Figure 1:
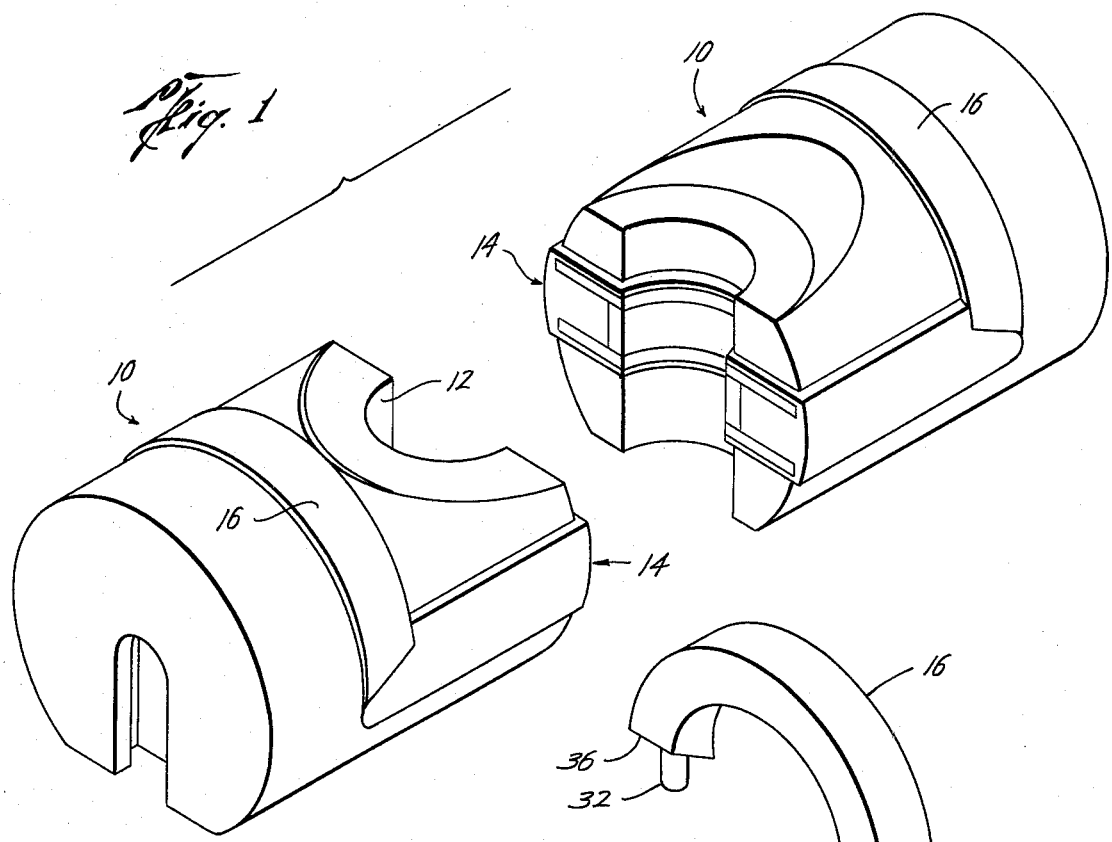
FIG. 1 is a schematic view of a pair of oppositely-facing BOP rams which include both front packer and top seals.

A pair of oppositely-facing rams 10 for use in conjunction with ram-type BOP's are shown in FIG. 1 and are designed to perform a stripping operation as described above where drill pipe is run into a well which has a relatively high well pressure for example, a pressure which exceeds 3,000 p.s.i. This type of operation is known in the art and will not be discussed in greater detail.

The rams 10 are moved toward and away from each other by appropriate hydraulically operated pistons (not shown). When the rams 10 move toward each other, semi-circular openings 12 located on their front ends surround a length of drill pipe (not shown) so that a front packer seal 14 mounted on each of the rams 10 will engage both the drill pipe and the packer seal 14 on the other ram 10 for forming a fluid-tight seal around the pipe. A top seal 16 mounted on each of the rams 10 provides a fluid-tight seal between each ram and the surrounding housing in a way which is known in the art. A seal is not necessary around the bottom side of the rams 10 since the combined operation of the packer and top seals will isolate the portions of the well on both sides of the BOP. The top seal 16 only needs to engage its surrounding housing when the packer seal 14 engages the drill pipe because there is no need for a fluid-tight seal between them at other times during the stripping operation.

Figure 2:
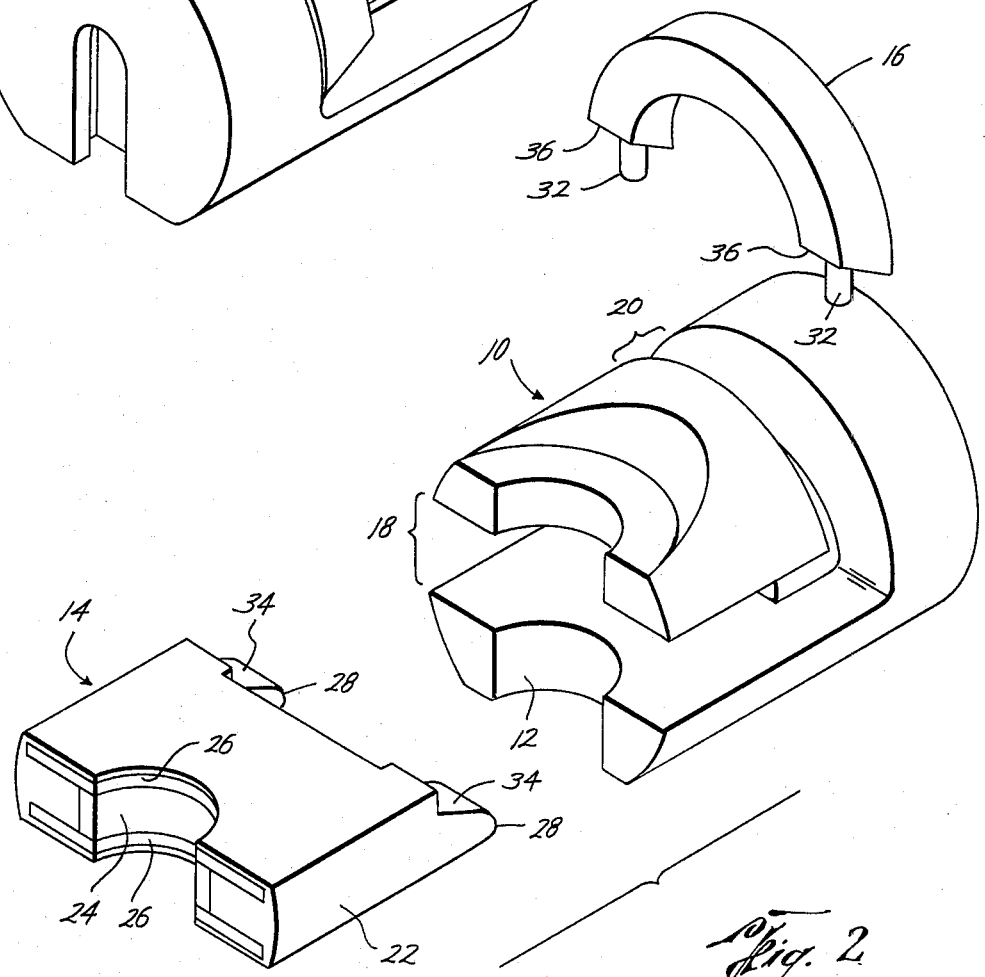
FIG. 2 is an exploded view of one of the rams of FIG. 1 showing, in particular, the configuration of the seals.

As shown best in FIG. 2, the front packer seal 14 can be removably inserted in a recess such as a slot 18 formed in the front and side surfaces of the ram 10. The top seal 16 can be removably inserted in a second recess located in the upper surface of the ram 10 in the form of a groove 20 which intersects the slot 18.

Figure 3:
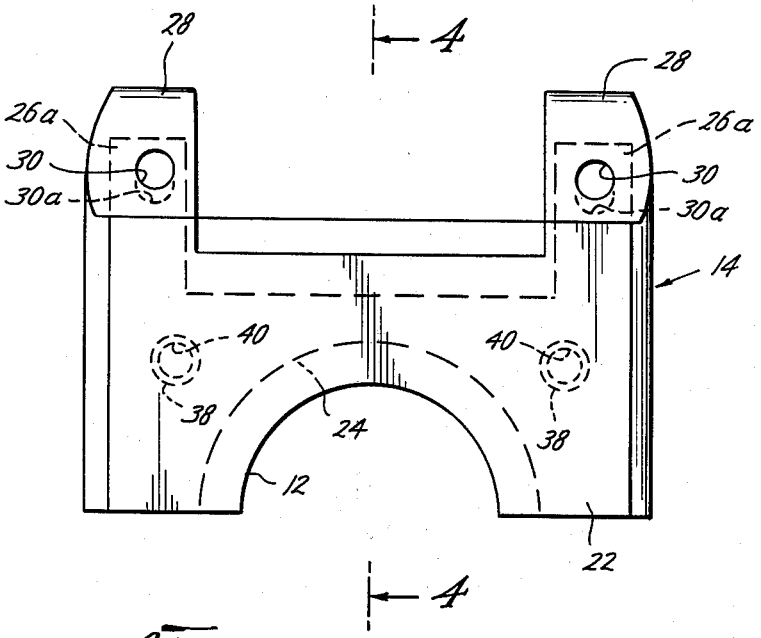
FIG. 3 is a top plan view of the front packer seal.
Figure 4:
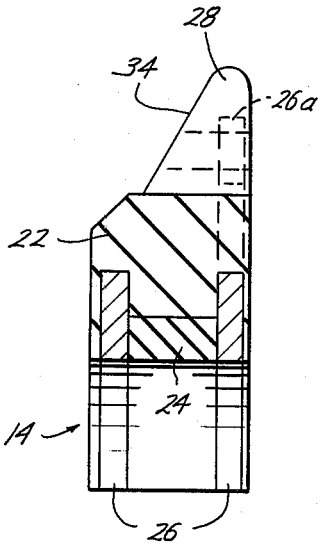
FIG. 4 is a side sectional view of the packer seal shown in FIG. 3 looking along a section line shown in FIG. 3 in the direction of arrows 4—4.
Figure 5:
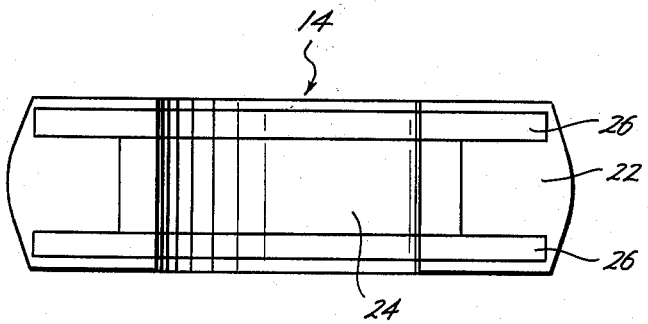
FIG. 5 is a front plan view of the front packer seal shown in FIG. 3.

As shown best in FIGS. 3–5, the front packer seal 14 is made up of a main body 22 which is formed of an elastomeric material such as, for example, natural or synthetic rubber. The packer seal 14 includes an insert 24 which is used to line the semi-circular recess 12 and is the portion of the packer seal 14 which engages the pipe. The insert 24 is formed of a low friction material which is self-lubricating so that movement of the pipe while it is engaged by the insert 24 will not cause excessive wear on the insert. A material with these characteristics which has been found to be satisfactory is made up of 75% by weight of tetrafluoroethylene, 2% molybdenum disulfide and 23% fiberglass and is commercially available under the tradename Jaylon 18.

The insert 24 is mounted in the body 22 between a pair of retainer plates 26 which are formed of a rigid material such as metal so that when the insert 24 engages the drill pipe it will not extrude outwardly within the body 22. As shown best in FIG. 4, the retainer plates 26 are large enough to stiffen the packer seal 14 and give it some rigidity. The lower retainer plate includes portions **26*a* which project beyond the rear end of the body 22 and into a pair of lugs 28 which are formed integral with the body 22 and project rearwardly from it. Each lug 28 includes an opening 30 in the body 22 which corresponds to an elongated hole 30*a* in portion 26*a*, the opening and hole receiving a retainer pin 32 connected to and projecting from each of the lower ends of the U-shaped upper seal 16 as shwon in FIG. 2. The elongated holes 30*a* allow movement of the retainer plate 26 in respect to the body 22. The pins 32 and openings 30 position the upper seal 16 relative to the packer seal 14 and allow them to interact relative to each other as described below. The pins 32 can be formed of metal and molded into the top seal 16** or they can be clipped onto the seal in a known way.

Each lug 28 also includes contact surface 34 which faces upwardly and is oriented at an acute angle relative to the body 22. The surfaces 34 cooperate with contact surfaces 36 formed at a complimentary angle on the outer ends of the upper seal 16 as shown in FIG. 2 so that force exerted by the pipe on the packer seal 14 is transmitted through the contact surfaces 34 and 36 and into the upper seal 16 causing it to move upwardly out of its groove 20 and engage the inner surface of the housing within which the ram 10 moves. When the force is relieved, the top seal 16 will return to its lower position out of engagement with the housing. In this way the useful life of the top seal 16 is extended because it will remain in the groove 20 and not tightly engage the housing until the packing seal 14 engages the pipe and raises the seal 16. A fluid-tight seal is thus formed between the packer seal 14 and pipe and the top seal and surrounding housing for preserving well-head pressure.

The packer seal 14 can be formed by fabricating the insert 24 of the material mentioned above and then etching it with a compound known as Tetraetch which is a tetrafluoroethylene compound sold by Fluorocarbon Company, Los Angeles, Calif. A rubber-to-metal bonding adhesive is applied to all the outer surfaces of the insert except the portion which engages the pipe. An adhesive known as TY-PLY-BN sold by Lord Corporation, Erie, Pa., has been found to be effective for this purpose.

FIGS. 4 and 5 show a pair of openings 40 in both retainer plates 26. The spacers 38 are placed between the plates 26 to keep the plates apart to a predetermined height. The insert 24, spacers 38 and retainer plates 26 are placed in a mold which is then charged with an appropriate elastomeric material such as synthetic or natural rubber which is then cured. The top seal 16 can be formed of a similar elastomeric material and the metal pins 32 are attached to brackets which are molded into the seal.

In this way, an improved front packer seal for a ram blowout preventer is provided which incorporates an insert with characteristics which result in longer seal life. The elastomeric properties of the seal and force transmitted through a contact surface between the ram and seal will push an insert in the seal into tight engagement with the drill pipe. Cooperating force transfer surfaces between the packer seal and the top seal forces the top seal upwardly to where it engages its surrounding housing after the packer seal engages the drill pipe which reduces wear on the top seal and increases its useful life. When the seals do wear out, replacement is a relatively simple operation.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

What is claimed is:

1. An improved sealing means for a blowout preventer ram of the type which can be reciprocally moved into and out of engagement with a well conduit position in the blowout preventer and includes intersecting recesses formed in the outer surfaces of the ram body for accommodating resilient sealing means for forming a fluid pressure-tight seal around the well conduit and between the ram and a portion of a housing in which the ram moves when the ram operably engages the well conduit, the improvement comprising:

a front seal having a face with a curved portion shaped to engage the well conduit including a body portion formed of an elastomeric material shaped to fit within one of the recesses in the ram; and an insert formed of a deformable material with low friction properties and positioned in the body portion to engage the well conduit when the ram is in the well conduit engaging position, the insert being held between a pair of rigid retainer plates oriented perpendicular to the well conduit and embedded within the body portion of said front seal.

2. The improvement of claim 1, wherein the body is formed of rubber.

3. The improvement of claim 1, wherein the insert is formed of a material made up of 75% by weight tetrafluoroethylene, 2% molybdenum disulfide and 23% fiberglass.

4. The improvement of claim 1, wherein the body and recess include cooperating angled contact surfaces for transmitting reactive force from the ram through the body.

5. The improvement of claim 1, wherein the body includes lug portions projecting into the other recess, a second seal in the other recess, the lugs and a second seal including cooperating angled contact surfaces for transmitting force from the body to the second seal and pushing it outwardly in its recess.

6. The improvement of claim 5, wherein the lugs include openings therein and the second seal includes positioning pins inserted in the openings.

7. The improvement of claim 6, wherein the retainer plates extend throughout substantially the entire body and one of the plates extends into the lugs.

8. The improvement of claim 7, wherein the insert and retainer plates are molded in the elastomeric material which forms the body.

9. An improved sealing means for a blowout preventer ram of the type which can be reciprocally moved into and out of engagement with a companion ram similarly movable in the blowout preventer and includes intersecting recesses formed in the outer surfaces of the ram body for accommodating resilient sealing means for forming a fluid pressure-tight seal with the companion ram and between the ram and a portion of a housing in which the ram moves when the ram operably engages the companion ram, the improvement comprising:

a front seal having a face to engage the companion ram including a body portion formed of an elastomeric material shaped to fit within one of the recesses in the ram; and an insert formed of a deformable material with low friction properties and positioned in the body portion to engage the companion ram when the ram is in the companion ram engaging position, the insert being held between a pair of rigid retainer plates embedded within the body portion of said front seal to retard extrusion of the insert during sealing use.

10. An improved sealing means for a blowout preventer ram which may be reciprocally moved in a ram cavity of a ram type blowout preventer housing for controlling flow of fluids, the ram having at least two intersecting recesses formed in the outer surfaces of the ram body for receiving the improved sealing means for sealing with a second companion ram and between the ram and a portion of the blowout preventer housing, the improvement in sealing means comprising:

a front seal releasably carried by the ram in one recess and having a body portion formed of an elastomeric material for coacting with the second ram to resiliently deform the elastomeric material to effect a seal therebetween to block passage of fluid through the blowout preventer;

an upper seal releasably carried by the ram in another recess for effecting a desired seal with the housing to block passage of fluid therebetween; and said upper seal radially expanded relative to the ram to seal with the blowout preventer housing when said front seal is sealingly deformed by the second ram.

11. The improvement of claim 10, wherein:

said body of said front seal forming lug portions extending into the recess carrying said upper seal, said lug portions and said upper seal having cooperating angled contact surfaces for transmitting force from the deformation of said body of the first seal by engagement with the second ram to move the upper seal radially outwardly.

12. An improved sealing means for a blowout preventer ram which may be reciprocally moved in a ram cavity of a ram type blowout preventer housing for controlling flow of fluids, the ram having at least two recesses formed in the outer surfaces of the ram body for receiving the improved sealing means for sealing with a second companion ram and between the ram and a portion of the blowout preventer housing, the improvement in sealing means comprising:

a front seal releasably carried by the ram in one recess and having a body portion formed of an elastomeric material for coacting with the second ram to resiliently deform the elastomeric material to effect a seal therebetween to block passage of fluid through the blowout preventer;

an upper seal releasably carried by the ram in another recess for effecting a desired seal with the housing to block passage of fluid therebetween; and means for radially expanding said upper seal relative to the ram to seal with the blowout preventer housing when said front seal is sealingly deformed by engagement with the second ram.

13. The improvement of claim 12, including:

an insert formed of deformable material having low friction properties embedded in said body of said front seal for sealing engagement with a well conduit operably disposed in the blowout preventer, said insert sealing with the well conduit to reduce seal damage from movement of the well conduit in the blowout preventer during sealing.

14. The improvement as set forth in claim 13, including:

said insert having a retainer plate secured thereto to prevent extrusion of the deformable insert material when positioned in sealing engagement with the well conduit.

15. An improved sealing means for a blowout preventer ram which may be reciprocally moved in a ram cavity of a ram type blowout preventer housing for controlling flow of fluids, the ram having a recess formed in the outer surface of the ram body for releasably receiving the improved sealing means for sealing with a second ram and between the ram and a portion of the blowout preventer housing, the improvement in sealing means comprising:

a front seal releasably carried by the recess formed in the ram and having a body portion formed of an elastomeric material extending outwardly from the ram for coacting with the second ram to resiliently deform the elastomeric material to effect a seal to block passage of fluid through the blowout preventer;

an upper seal carried by the ram for effecting a desired seal with the housing to block passage of fluid therebetween, said upper seal radially expanded relative to said ram to sealingly engage the blowout preventer housing when said front seal is sealingly deformed by the engagement with the second ram.

* * * * *